US005736702A

United States Patent [19]

Roberts et al.

[11] Patent Number: 5,736,702

[45] Date of Patent: Apr. 7, 1998

[54] PNEUMATIC SWITCH FOR PATIENT CALL SYSTEM HAVING MULTIPLE-POSITION HOUSING ASSEMBLY

[75] Inventors: George A. Roberts, Orlando; Bert W. Wechtenheiser, Ponte Vedra Beach, both of Fla.

[73] Assignee: Dwyer Precision, Inc., Jacksonville, Fla.

[21] Appl. No.: 663,623

[22] Filed: Jun. 14, 1996

[51] Int. Cl.[6] ..... H01H 35/24

[52] U.S. Cl. ..... 200/81 H; 128/681; 200/83 Z; 200/505; 340/573

[58] Field of Search ..... 73/745; 340/626, 340/573; 307/118; 128/681, 203, 28; 222/206, 209; 60/533; 200/81 R, 51 H, 82 R, 83 Z, 302.1, 333, 505

[56] References Cited

U.S. PATENT DOCUMENTS

| | | | |
|---|---|---|---|
| 3,823,285 | 7/1974 | Dwyer | 200/81 H |
| 4,150,264 | 4/1979 | Lieberman | 200/51 LM |
| 5,113,048 | 5/1992 | Lafferty | 200/83 Z |
| 5,155,309 | 10/1992 | Dwyer | 200/81 H |
| 5,461,207 | 10/1995 | Van Lear | 200/81 H |

FOREIGN PATENT DOCUMENTS

| | | | |
|---|---|---|---|
| 262429 | 6/1968 | Austria | 200/83 Z |

*Primary Examiner*—Gerald P. Tolin
*Attorney, Agent, or Firm*—Clifford A. Poff

[57] ABSTRACT

A pneumatically actuated switching device is disclosed for forming a momentary electrical signal circuit with a receptacle of a patient call system utilizing a conductive plunger which slides in response to a pulse of pressurized air delivered to an internal chamber through a housing connection which provides for optional assembly orientations. A spring is used to maintain separation between a conductive plunger and the electrical components when the pneumatic switching device is not activated by a patient.

14 Claims, 5 Drawing Sheets

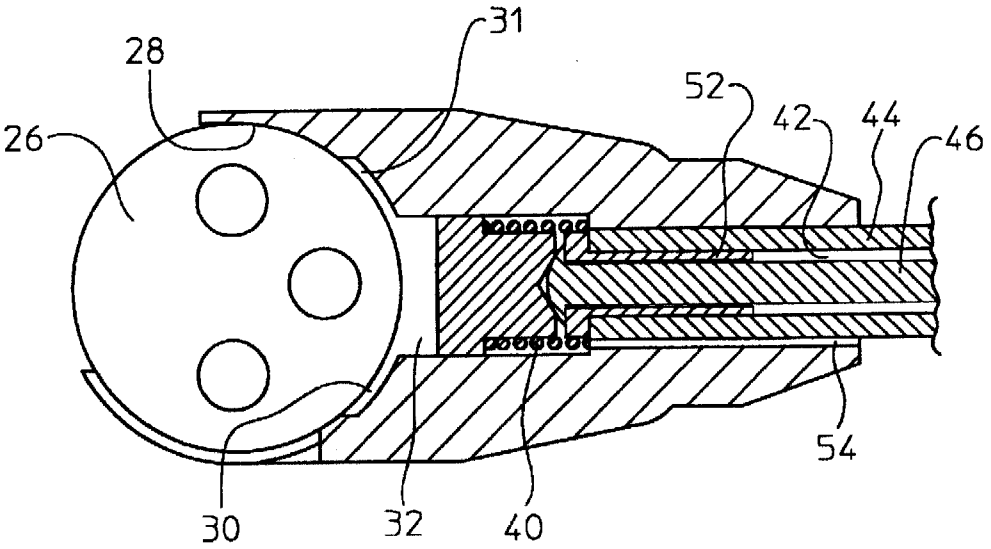
FIG. 4
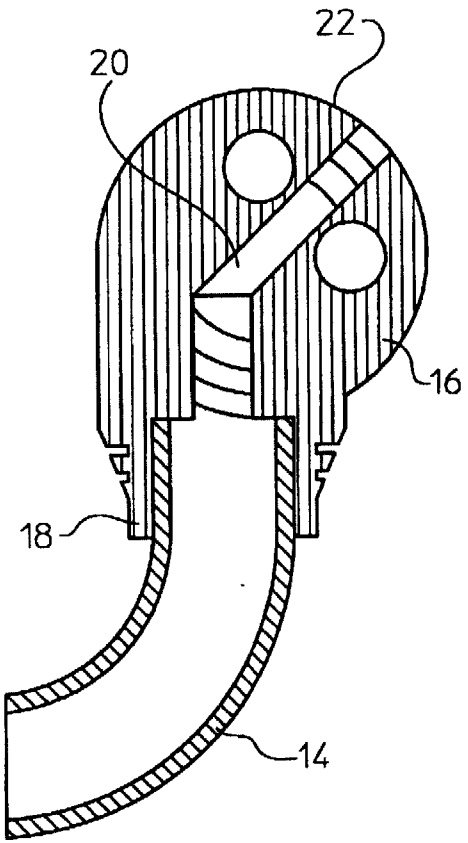

PNEUMATIC SWITCH FOR PATIENT CALL SYSTEM HAVING MULTIPLE-POSITION HOUSING ASSEMBLY

BACKGROUND OF THE INVENTION

1. Field of the Invention

This invention relates to a pneumatically actuated switching device for a patient call system, and more particularly to a switching device having a conductive plunger responsive to pressurized air delivered from a hose/housing connection which allows for multiple assembly orientations.

2. Description of the Prior Art

Hospitals, and other patient-care institutions, frequently provide patient call systems wherein a patient may activate a signal to a central station, such as nurse's station, to summon assistance. The use of conventional electrical switches to generate the signal in such environments is undesirable given the potentially combustible levels of oxygen that will likely be present near the patient.

As an alternative to conventional electrical switches, the use of a pneumatically actuated switch, which utilizes a pulse of pressurized air to actuate a signal circuit, avoided the safety concerns associated with a conventional switch. Such a device, however, should have the ability to complete a signal circuit in response to a relatively weak pneumatic pulse in order to accommodate patients who may be in a debilitated state and therefore unable to generate a large pressure pulse.

Examples of prior art pneumatically actuated switching devices for patient call systems can be found in U.S. Pat. No. 3,823,285 and U.S. Pat. No. 5,113,048 to Lafferty. While the '285 Patent provided an entirely satisfactory solution to the need for a pneumatically actuated switch for a patient call system, the design of the switch left room for improvement. The use of the conductive ball slidable in an air tight relation along a sleeve according to the '285 patent depends on gravity forces to reset the switch components once the pressure pulse has made the contact necessary to complete the signal circuit. Therefore, optimum functioning of the device requires that the device be positioned so that the sleeve is in a generally vertical orientation.

U.S. Pat. No. 5,113,048 to Lafferty incorporates a tightly sealed chamber for the pressure pulse in order to compress a deformable diaphragm confronting the chamber. The compression of the diaphragm results in the contact of conductive elements required to complete the signal circuit. The relatively large size of the diaphragm in relation to the chamber requires maximal use of the available pressure pulse in order to ensure that the volume of air that is required to compress the diaphragm is present in the chamber. This design is therefore unforgiving of pressure losses and necessitates the tightly sealed volume which includes the bulb, tubing and the chamber.

SUMMARY OF THE INVENTION

According to the present invention, there is provided a pneumatically actuated switch for a patient call system, the switch including means for generating and discharging a quantity of pressurized air, tubing having a first end connected to the means for generating and an opposite second end, a connector having a first end connected to the second end of the tubing and an opposite second end having a surface, the connector having an internal passage extending through the connector between the ends, a housing having a first end with a cavity for enclosing at least a portion of the second end of the connector and an opposite second end, the first end of the housing having a surface which is capable of interfitting with the surface of the second end of the connector, the surface of the housing including a recessed portion for forming a chamber communicating with the internal passage of the connector upon interfacing contact between the surfaces, the housing further including an internal opening having a first end communicating with the recessed portion and an opposite second end, means at least partially contained within the internal opening in the housing for creating a momentary electrical connection in response to the pressurized air, and means connecting the connector to the housing for maintaining the interfacing contact between the surfaces, the means for maintaining providing for a plurality of assembly options each having a different angular orientation of the connector relative to the housing while maintaining communication between the internal passage of the connector and the recessed portion of the housing.

DESCRIPTION OF THE DRAWINGS

The present invention will be more fully understood when the following description is read in light of the accompanying drawings in which:

FIG. 4 is an exploded side sectional view of the right angle switching device of FIG. 2 with the pins and end walls removed for clarity showing the arrangement of components during switch contact in response to a pressure pulse.

DESCRIPTION OF THE PREFERRED EMBODIMENTS

Figure 1:
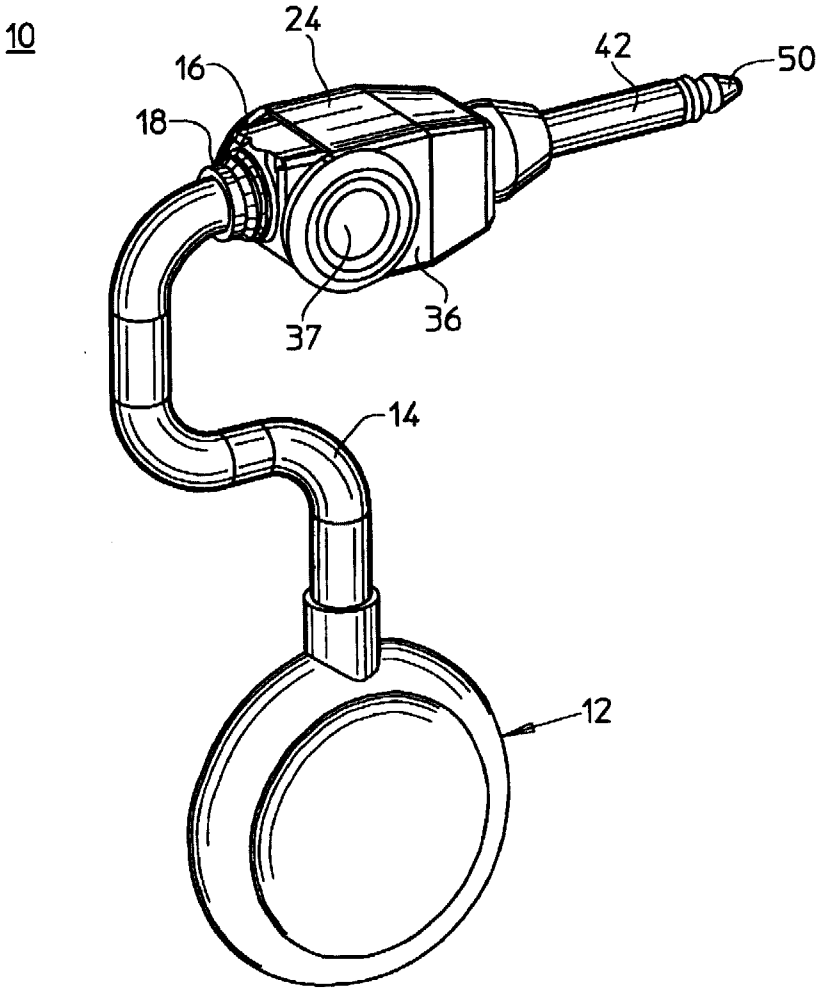
FIG. 1 is a perspective view of a pneumatically actuated switching device according to the present invention utilizing an in-line hose/housing connection assembly option.
Figure 2:
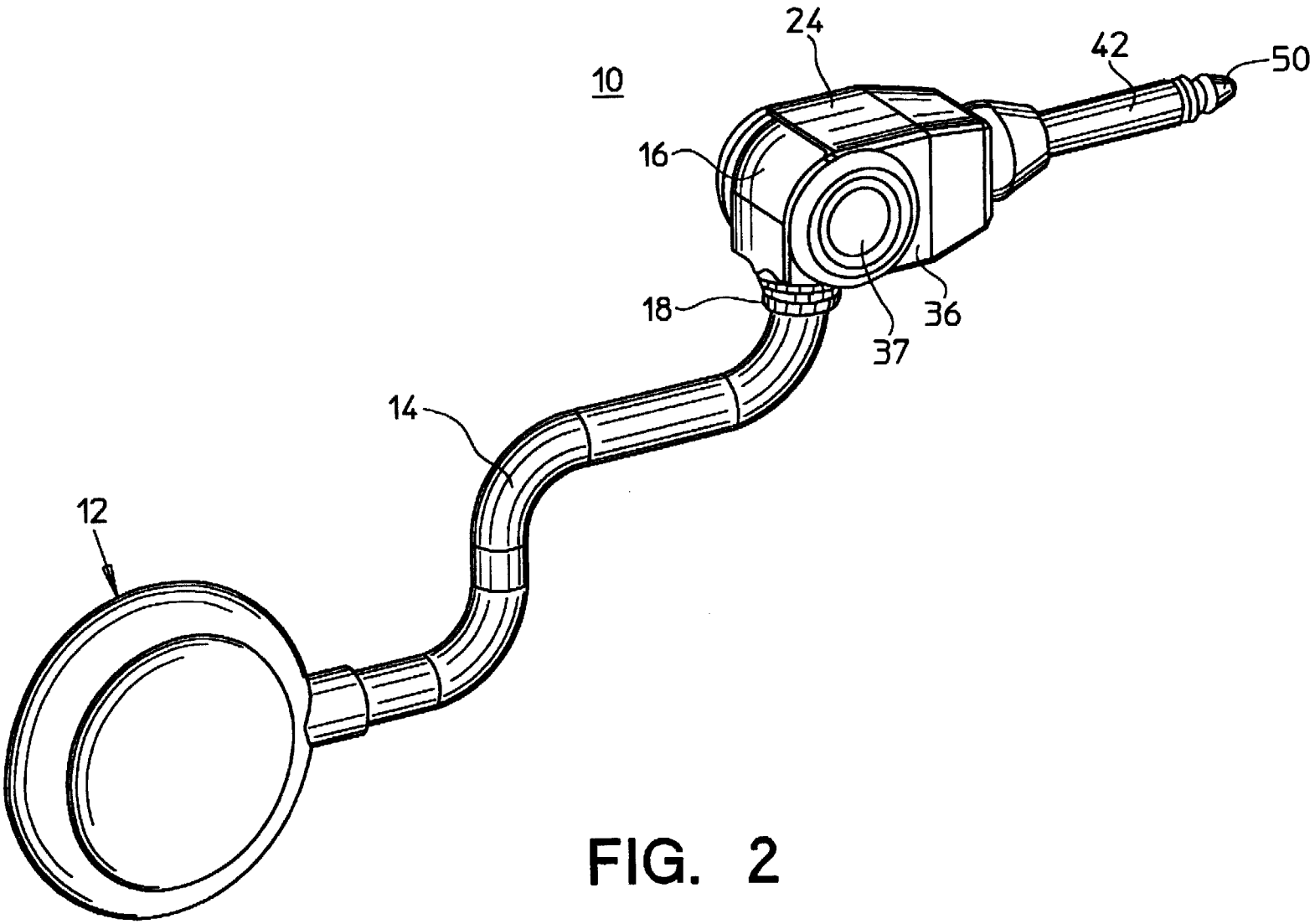
FIG. 2 is a perspective view of a pneumatically actuated switching device according to the present invention utilizing a right angle hose/housing connection assembly option.

In FIGS. 1 and 2, isometric views show a pneumatic switch assembly 10 for providing a signal in a patient call system according to the present invention. FIG. 1 shows an in-line assembly configuration for the switch housing and FIG. 2 shows a right angle configuration, the assembly options being described below. The switch responds to a relatively weak pressure pulse to create a momentary electrical connection. The pressure pulse may be generated by a squeeze bulb 12. Such bulbs are, per se, well known in the art, examples of which are described in U.S. Pat. No. 5,461,207 to Van Lear, and U.S. Pat. No. 5,155,309 to Dwyer. Typically, the bulb will include a deformable actuator confronting a pressure chamber. When a user of the device places pressure on the actuator, the deformation of the actuator causes compression of the pressure chamber resulting in the weak pressure pulse.

The pressure pulse is conveyed from the bulb 12 by tubing, such as the pneumatic hose 14, to the connector 16. The connector allows for multiple assembly options each providing for a different angular orientation of the connector. The connector 16 is made of a nonconducting material, such as plastic, and includes a strain-relieving section 18, in the region of the connection of the hose 14 to the connector 16.

Figure 3:
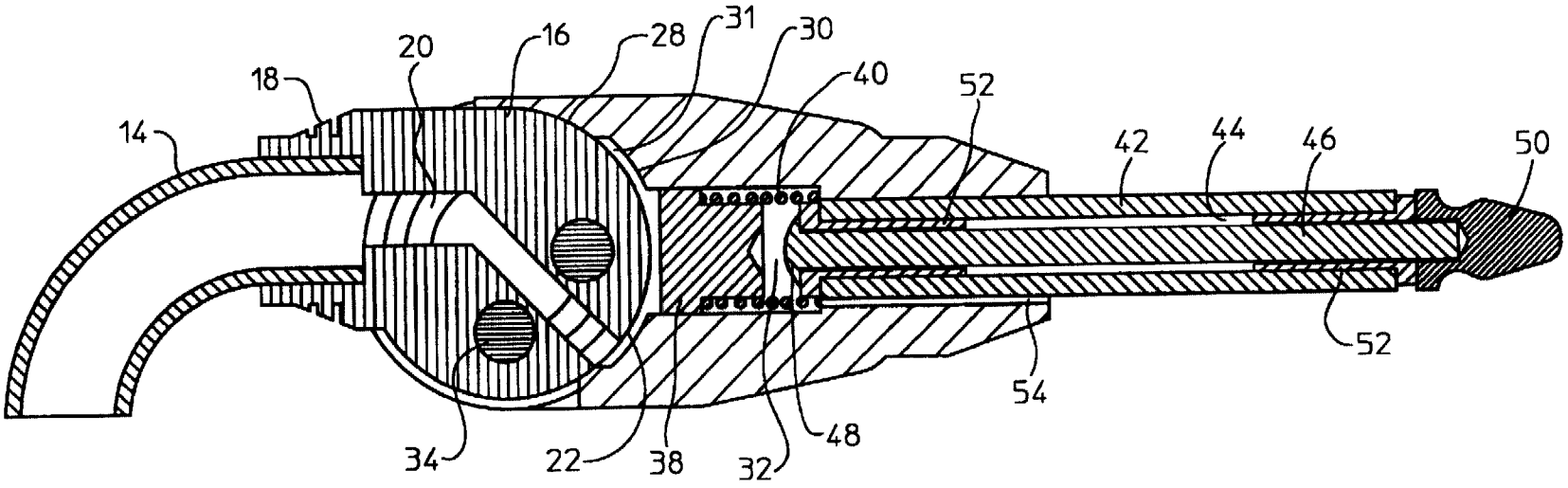
FIG. 3 is a side sectional view of the switching device of FIG. 1 showing the arrangement of components during the absence of a pressure pulse.
Figure 5:
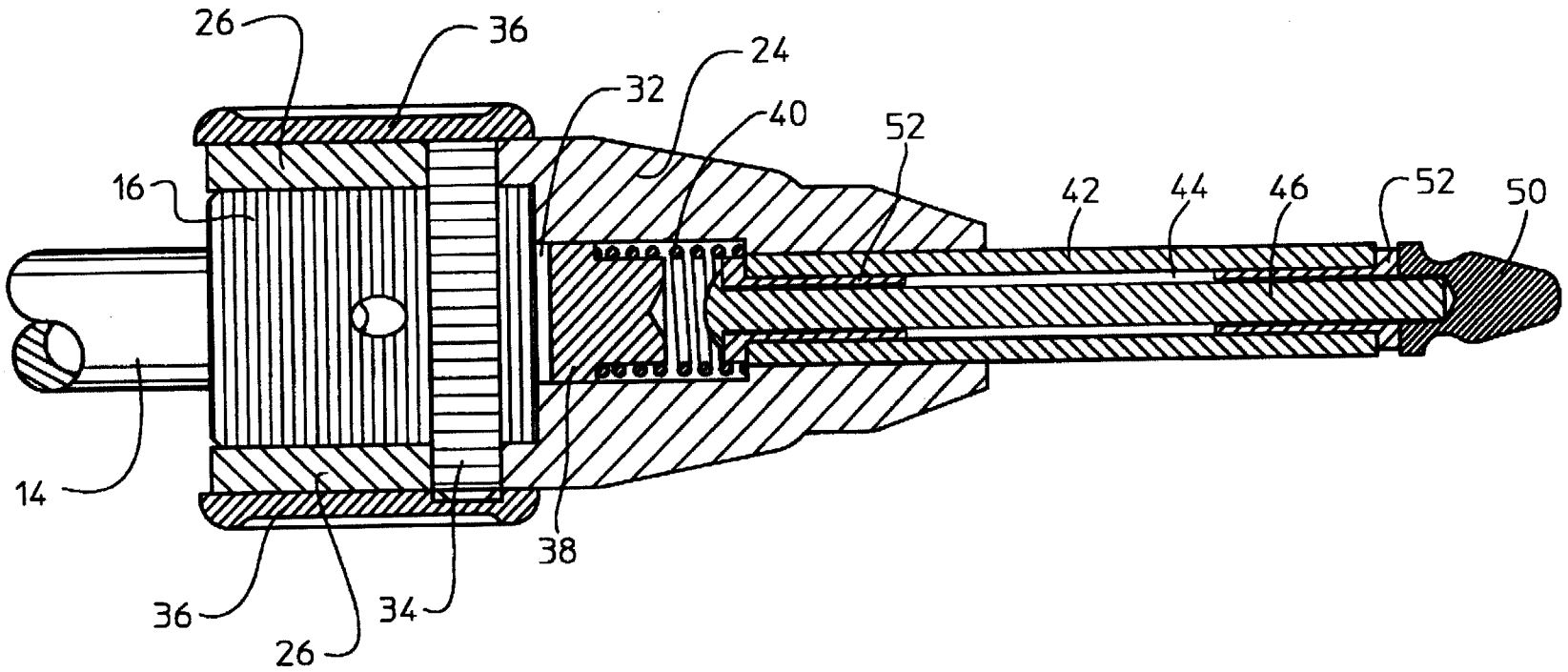
FIG. 5 is a top sectional view of the switching device of FIG. 1.

Turning to FIG. 3 through 5, the construction of the switch components may be seen. The connector includes an internal passage 20 extending through the connector from a first end of the connector connected to the hose 14 to an opposite second end of the connector. The second end of the connector 16 includes a curved surface 22.

The connector 16 is partially enclosed within a cavity formed in an end of a housing 24. The cavity of the housing 24 includes opposing side walls 26, as seen in FIG. 5, and a curved surface 28 located between the side walls. The contour of the curved surface 28 is compatible with the surface 22 of the connector 16 such that the two components can be brought into interfacing contact with one another. Although the preferred embodiment involves continuously curving surfaces 22 and 28, other geometries could be employed as well, such as a surface including multiple planar segments. Curved surface 28 of the housing 24 also has a recessed portion 30 for forming a chamber 31 when the curved surfaces of the connector and the housing are brought into interfacing contact with one another. The recessed portion 30 is located so that the end of the passage 20 will confront the chamber 31 for each of the possible assembly options, which will be discussed below. The housing further includes an internal opening, such as central bore 32, which has an end communicating with the recessed portion 30. The housing is made from a nonconducting material, such as plastic. The construction described above provides a pathway for the pulse of pressurized air which extends from the bulb 12, through the tubing 14, to the internal passage 20 of the connector 16 and into the central bore 32 of the housing 24 via the chamber 31.

To maintain the interfacing contact between the connector and the housing, which provides sealing contact for the pressure pulse within the chamber 31, pins 34 extend through the connector 16 and through the opposing side walls 26 of the housing 24 thereby locking the two components together in a preselected angular orientation of the connector relative to the housing. The pair of pins 34 shown, require two openings in the connector 16 and in each of the side walls 26 of the housing 24. The inclusion of the additional openings in the side walls 26 provides for the different angular orientation options for the connector during the assembly of the switch. End caps 36 as seen in FIG. 5 form the final closure for maintaining the locked assembly orientation by retaining the pins within the openings in the connector and the housing. The pins may be integral with one of the end caps, as shown in FIG. 5, or alternatively may be separate components. One of the end caps 36 includes openings for seating of ends of the pins 34 extending from the openings in the side walls 26 of the housing 24. The end caps also include concave portions 37 on the external surfaces, as seen in FIGS. 1 and 2, for improved gripping of the assembled switch.

A portion of the assembly which will make the temporary electrical connection is housed within the center bore 32 of the housing 24. This includes a conductive plunger 38 which is slidably contained within the central bore. As will be apparent to one skilled in the art, a relatively close tolerance fit will be required between the plunger 38 and the bore 32 to ensure that the plunger will slide in response to a pressure pulse delivered to the chamber 31. If too great a gap exists between the plunger and the bore, the pulse of air might pass by the plunger instead of driving the plunger into the bore.

The plunger 38 has a reduced diameter portion opposite from the end of the plunger which confronts the chamber 31 thereby creating a ledge for contact with a spring 40. The spring acts to maintain separation, in the absence of a pressure pulse, between the plunger 38 and a portion of the electrical connection components, as will be described in greater detail below.

The switch assembly includes a jack extending from an end of the housing for electrical connection with the receptacle of a patient call system. The jack includes a conductive outer body 42 having an inner cavity 44 extending along the entire elongated length of the outer body 42. As seen in FIG. 3, the outer body 42 is positioned within an opening in the housing such that an end of the outer body confronts the end of the central bore 32. The outer body 42 and the opening in the housing are toleranced so that a slight interference fit will exist to maintain the position of the outer body. The outer body 42 further includes a knurled portion in the region of the connection to the housing to enhance the gripping strength of the connection. Within the cavity 44, a conductive core 46 is housed, the core extending beyond both ends of the outer body 42 thereby forming at one end an extension 48 which extends into the central bore 32 for contact with plunger 38. The core extends from the opposite end of the outer body 42 to connect to a conductive jack tip 50. The plunger 38 and the extension 48, as shown, have compatible interfitting surfaces providing for conductive contacting surfaces. Insulators 52 provide for electrical separation between the jack tip 50 and the outer body 42 and between the core 46 and the outer body 42.

An important feature in the functioning of the switch involves an additional purpose of the spring 40 beyond that of providing for the above described separation, which will exist in the absence of a pressure pulse, between the plunger 38 and the extension 48 of the jack core 46. The spring is made from a conductive material so that the spring also provides for an electrical pathway to exist between the plunger 38 and the end of the outer body 42 confronting the central bore 32 through the spring 40. The spring 40 has an end section with a reduced diameter spiral for seating of that portion of the spring between the outer body 42 and insulator 52 thereby ensuring good conductive contact between the spring and the outer body.

The temporary electrical connection will result in the following manner. A first electrical pathway will exist between the receptacle and the plunger 38 through the outer body 42 and the spring 40. A second pathway will extend from the receptacle to the extension 48 of the jack core 46 through the jack tip 50. The first and second pathways are kept electrically separated from one another by the insulators 52 between the core 46 and outer body 42 and between the jack tip 50 and the outer body 42. Upon the entrance of a pressure pulse into the chamber 31 and the central bore 32, the plunger will slide in the central bore resulting in contact between the interfitting surfaces of the plunger 38 and the core extension 48. This contact will unite the two electrical pathways resulting in an electrical signal, which may be monitored at a central location such as a nurse's station, indicating that the switch has been activated.

The sliding of the plunger is facilitated by the inclusion of a bleed pathway 54 in the housing extending from the end of the central bore 32 opposite the chamber 31 to the end of the housing. The pathway 54 allows for the escape of air present in the central bore 32 and adjacent to the spring 40 which would otherwise be pressurized in the absence of the bleed pathway.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A pneumatically actuated switch for a patient call system, the switch including:

(a) means for generating and discharging a quantity of pressurized air;

(b) tubing having a first end connected to said means for generating and an opposite second end;

(c) a connector having a first end connected to the second end of said tubing and an opposite second end having a surface, said connector having an internal passage extending through said connector between said ends;

(d) a housing having a cavity formed in a first end for enclosing at least a portion of the second end of said connector and an opposite second end, the housing including a surface which is capable of interfitting with the surface of the second end of said connector, the surface of said housing including a recessed portion for forming a chamber communicating with the internal passage of said connector upon interfacing contact between the surfaces, the housing further including an internal opening having a first end communicating with the recessed portion and an opposite second end;

(e) means at least partially contained within said internal opening in said housing for creating a momentary electrical connection in response to said pressurized air; and (f) means connecting said connector to said housing for maintaining the interfacing contact between the surfaces.

2. The switch of claim 1, wherein said means for maintaining provides for a plurality of assembly options each having a different angular orientation of said connector relative to said housing while maintaining communication between the internal passage of said connector and the recessed portion of said housing.

3. The switch of claim 2, wherein said cavity further includes opposing side walls and wherein said means for maintaining includes two openings in said connector, three openings in at least one of the side walls of said cavity and two pins which extend between the pivot and said side wall, the three openings in said side wall providing for the plurality of assembly options utilizing the two pins.

4. The switch of claim 1, wherein said means for generating includes a bulb having a pneumatic pump chamber and an actuator.

5. The switch of claim 1, wherein said connector includes a strain relieving section at the first end of said connector.

6. The switch of claim 1, wherein said means for creating includes a conductive plunger slidably contained within the internal opening in said housing and means extending from the second end of said housing for establishing a conductive engagement of said switch to a receptacle and a spring having an end in contact with said plunger and an opposite end in contact with said means for establishing for separating said plunger from said means for establishing, said plunger sliding within the internal opening in response to the pressurized air into temporary contact with said means for establishing resulting in said momentary electrical connection.

7. The switch of claim 6, wherein said means for establishing includes a conductive outer body having a first end extending from said housing and an opposite second end confronting the second end of the internal opening of said housing, said outer body further having an inner cavity, said means for establishing further including a conductive inner core located within said inner cavity and having a first end extending beyond the first end of said outer body and a second end extending beyond the second end of said outer body thereby forming an extension into the internal opening in said housing for contacting said plunger, said means for establishing further including a conductive tip attached to the first end of said inner core, said outer body electrically separated from said core and said tip by insulating means, said plunger together with said spring, outer body, and receptacle forming a first electrical path, said core together with said tip and said receptacle forming a second electrical path, said first and second paths momentarily connected upon said discharge of said pressurized air.

8. The switch of claim 6, further including a bleed passageway in said housing having an end confronting the second end of the internal opening in said housing and extending to the second end of the housing allowing for the sliding of said plunger within the internal opening in said housing in response to the pressurized air by venting air which would otherwise be pressurized.

9. The switch of claim 2, wherein said cavity in said housing includes opposing side walls and wherein said means for maintaining includes at least one pin extending between said connector and at least one of the side walls of said cavity.

10. The switch of claim 9, wherein said at least one side wall has a through hole for receiving said pin and wherein said means for maintaining further includes means in contact with said pin for retaining said pin within the opening in said at least one side wall.

11. The switch of claim 10, wherein said means for retaining includes an end cap covering the through hole in said at least one side wall.

12. The switch of claim 11, wherein each of the opposing side walls of said cavity has a through hole for receiving said pin and wherein said means for retaining includes end caps covering both of said side walls.

13. The switch of claim 12 wherein at least one of said end caps has a hole for receiving an end of said pin.

14. The switch of claim 10 wherein said means for retaining includes an end cap which is joined to an end of said pin for covering the through hole in said at least one side wall.

* * * * *